US007336140B2

(12) United States Patent
Mazzochette et al.

(10) Patent No.: US 7,336,140 B2
(45) Date of Patent: Feb. 26, 2008

(54) LOW TEMPERATURE CO-FIRED CERAMIC-METAL CIRCULATORS AND ISOLATORS

(75) Inventors: Joseph Mazzochette, Cherry Hill, NJ (US); John Ekis, Egg Habor City, NJ (US)

(73) Assignee: Lamina Lighting, Inc., Westampton, NJ (US)

( * ) Notice: Subject to any disclaimer, the term of this patent is extended or adjusted under 35 U.S.C. 154(b) by 0 days.

(21) Appl. No.: 11/364,272

(22) Filed: Feb. 28, 2006

(65) Prior Publication Data

US 2006/0170513 A1 Aug. 3, 2006

Related U.S. Application Data

(62) Division of application No. 10/645,641, filed on Aug. 21, 2003, now abandoned.

(51) Int. Cl.
*H01P 1/387* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 3,935,549 | A * | 1/1976 | Jachowski | 333/1.1 |
| 5,644,327 | A * | 7/1997 | Onyskevych et al. | 345/80 |
| 2001/0024144 | A1 * | 9/2001 | Furuya et al. | 333/1.1 |
| 2003/0090335 | A1 * | 5/2003 | Lombardi et al. | 333/1.1 |

* cited by examiner

*Primary Examiner*—Stephen E. Jones
(74) *Attorney, Agent, or Firm*—Darby & Darby

(57) ABSTRACT

A low temperature cofired ceramic-metal (LTCC-M) integrated circulator comprises at least one ferrite disk situated in a magnetic field. The magnetic field is created by a magnet and directed by a ferrous base plate acting as a magnetic return path. A conductor junction having 3 ports couples radio frequency energy to the circulator. And, a plurality of LTCC-M insulating layers position the magnet, the ferrite disk, and supports the conductor junction. A method of making an LTCC-M circulator comprises, providing one or more green sheets of insulating ceramic, at least one magnet and at least one ferrous base plate, a contact junction, and alternately stacking the sheets so that there is at least one insulating ceramic sheet between the magnet and the ferrite disk. The stack is then co-fired to form an integrated LTCC-M circulator device.

10 Claims, 6 Drawing Sheets

LOW TEMPERATURE CO-FIRED CERAMIC-METAL CIRCULATORS AND ISOLATORS

CROSS-REFERENCE TO RELATED APPLICATION

This is a divisional application of U.S. patent application Ser. No. 10/645,641, filed Aug. 21, 2003 now abandoned, titled "Low Temperature Co-fired Ceramic-Metal Circulators and Isolators". U.S. patent application Ser. No. 10/645,641 is hereby incorporated herein by reference.

FIELD OF THE INVENTION

This invention relates to radio frequency (RF) circulators and isolators, and in particular to low temperature co-fired ceramic on metal (LTCC-M) technology micro-strip and strip-line integrated circulators and isolators.

BACKGROUND OF THE INVENTION

RF Circulators are three port components used to direct RF energy selectively between the ports as a function of the direction of the RF propagation. Circulators and isolators are typically useful at frequencies ranging from very high frequency (VHF) to microwave frequencies. A typical application involves routing RF signals from a transmitter to an antenna, while blocking undesirable signals reflected back towards the transmitter during a transmission. A circulator does this by routing the reflected signals to a port having a resistive termination to dissipate the reflected energy as heat. When configured this way, the combination of the circulator and the resistive load is called an isolator.

Circulators typically comprise a conductor junction to couple RF energy to the circulator. The conductor is located near a ferrite component situated in a magnetic field, usually provided by a permanent magnet. A passive metal ferrous component completes the static magnetic field caused by the magnet.

Radio signals are coupled to the circulator by transmission lines. Integrated radio circuits generally use integrated transmission lines. The most common types of integrated transmission lines are micro-strips and striplines. Micro-strip lines typically comprise a flat thin rectangular signal-carrying conductor situated above a flat ground plane. Stripline comprise a flat thin rectangular conductor situated between two grounds (planes or slightly larger flat rectangular conductors). In both cases the dimensions of the conductors and the spacing between them establish the electrical characteristics of the transmission line.

FIG. 1 shows an exemplary circulator with stripline transmission lines. Ferrite discs 12 and ground planes 13 surround conductor junction 14 to create the stripline transmission line. Magnets 11 act in conjunction with ferrite discs 12 to form the circulator. FIG. 2 shows an exemplary micro-strip device. Here, conductor junction 14, ferrite disc 12, and ground plane 13 form the micro-strip transmission line. The circulator is formed by ferrite disc 12 operating in the magnetic field established by permanent magnet 11.

Low temperature co-fired ceramic on metal (LTCC-M) is a relatively new packaging technique. It is a superior media because of its high thermal conductivity, good resistivity, and high frequency impedance. LTCC-M devices are mechanically robust, can be hermetically sealed, and are relatively inexpensive to fabricate.

It would be highly desirable to be able to provide RF circulators and isolators with both micro-strip and stripline transmission lines in an integrated LTCC-M package.

SUMMARY OF THE INVENTION

A low temperature cofired ceramic-metal (LTCC-M) integrated circulator comprises at least one ferrite disk situated in a magnetic field. The magnetic field is created by a magnet and directed by a ferrous base plate acting as a magnetic return path. A conductor junction having 3 ports couples radio frequency energy to the circulator. And, a plurality of LTCC-M insulating layers position the magnet, the ferrite disk, and support the conductor junction.

A method of making an LTCC-M circulator comprises, providing one or more green sheets of insulating ceramic, at least one magnet and at least one ferrous base plate, a contact junction, and alternately stacking the sheets so that there is at least one insulating ceramic sheet between the magnet and the ferrite disk. The stack is then co-fired to form an integrated LTCC-M circulator device.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that the drawings are for the purpose of illustrating the concepts of the invention, and are not to scale.

DETAILED DESCRIPTION

This description is divided into two parts. In Part I we describe general features of LTCC-M ferrite circulators and isolators in accordance with the invention and illustrate exemplary embodiments. In Part II we describe general features of LTCC-M packages.

I. LTCC-M Ferrite Circulators

Figure 1:
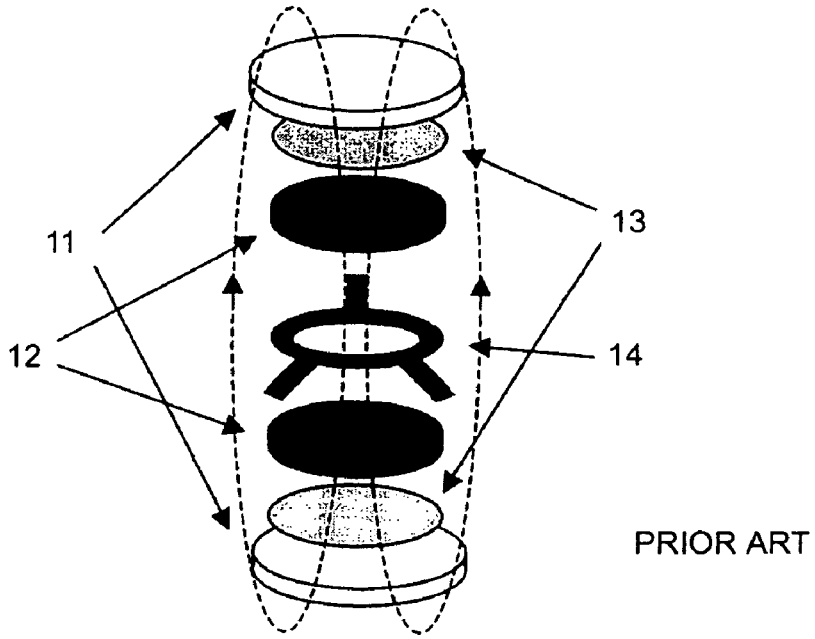
FIG. 1 is a schematic view of a ferrite circulator with two ferrite discs.
Figure 2:
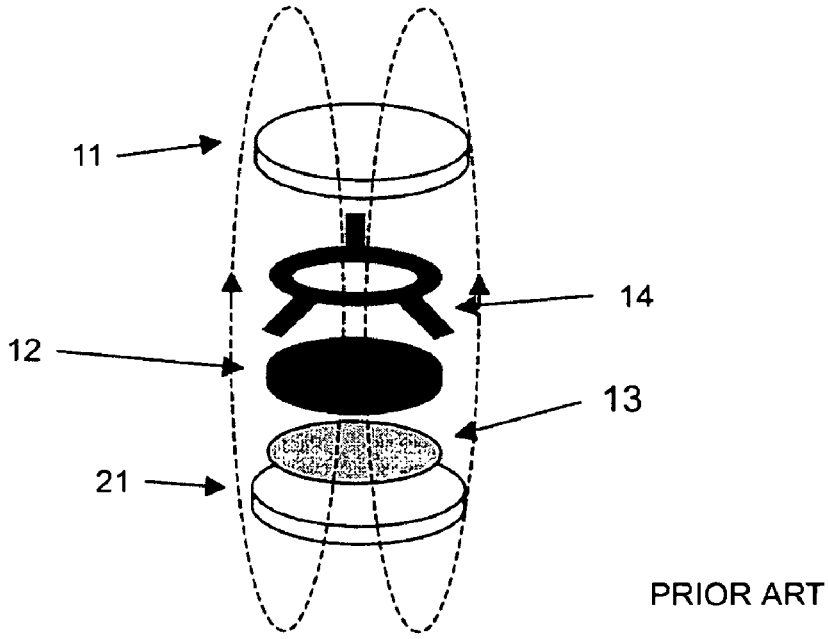
FIG. 2 is a schematic view of a ferrite circulator using one ferrite disc.
Figure 3:
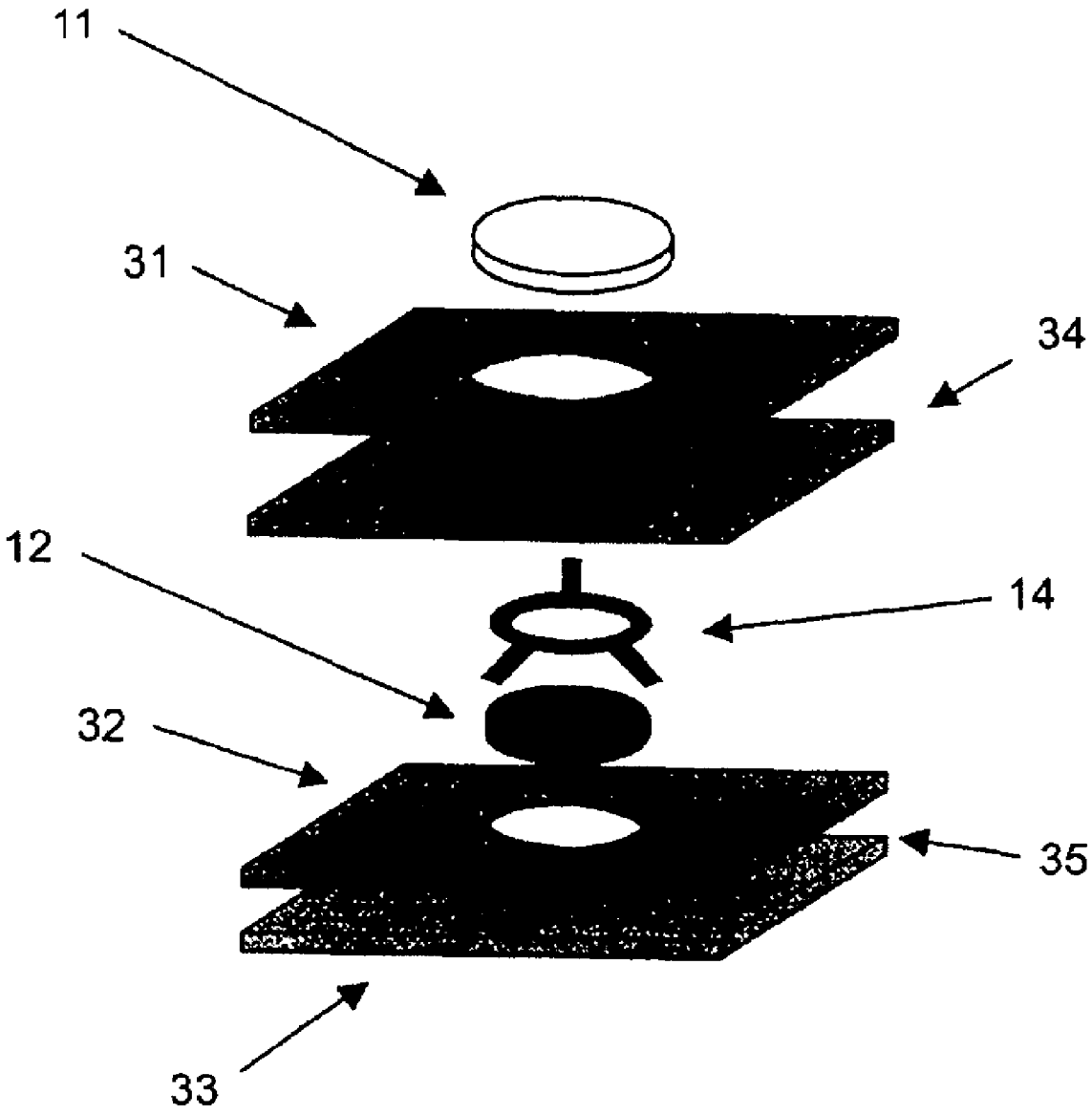
FIG. 3 is a schematic view of an LTCC-M ferrite micro-strip integrated circulator.

FIG. 3 shows an LTCC-M integrated circulator structure. Ferrite disk 12 is contained and protected by insulating layer 32. Insulating layer 32 can have an electrically conductive ground plane 35 on one or both surfaces. Ferrite disk 12 and the insulating layer rest on a ferrous base 33 that also provides the return path for the magnetic field created by permanent magnet 11. Permanent magnet 11 is housed in insulating layer 31 that also serves to position the magnet over ferrite disk 12. Conductor junction 14 rests on ferrite disk 12. Ferrite 12 is electrically insulating. It is held in place and sealed by insulating layer 34. Insulating layer 34 also supports insulating layer 31 and magnet 11.

EXAMPLE

An LTCC-M integrated circulator is fabricated according to FIG. 3. Ferrite disk 12 is an Nd—Fe—B material such as type N33 from Stanford Magnetics Company. Ferrous base 33 can be made of steel or a Kovar, such as Carpenter Steel UNS K94 612. Suitable insulators include ceramic, fiberglass, plastic, and low temperature co-fired ceramics such as DuPont 951. Conductor junction 14 can be formed on one side of the insulating layer 34 by screen printing, evaporation, sputtering, and other methods. Ferrous layer 33 can be joined to the insulating layer by epoxy, brazing, or soldering. The LTCC-M packaging can also provide a hermitic seal, typically by brazing metallization layers deposited on insulators.

Figure 4:
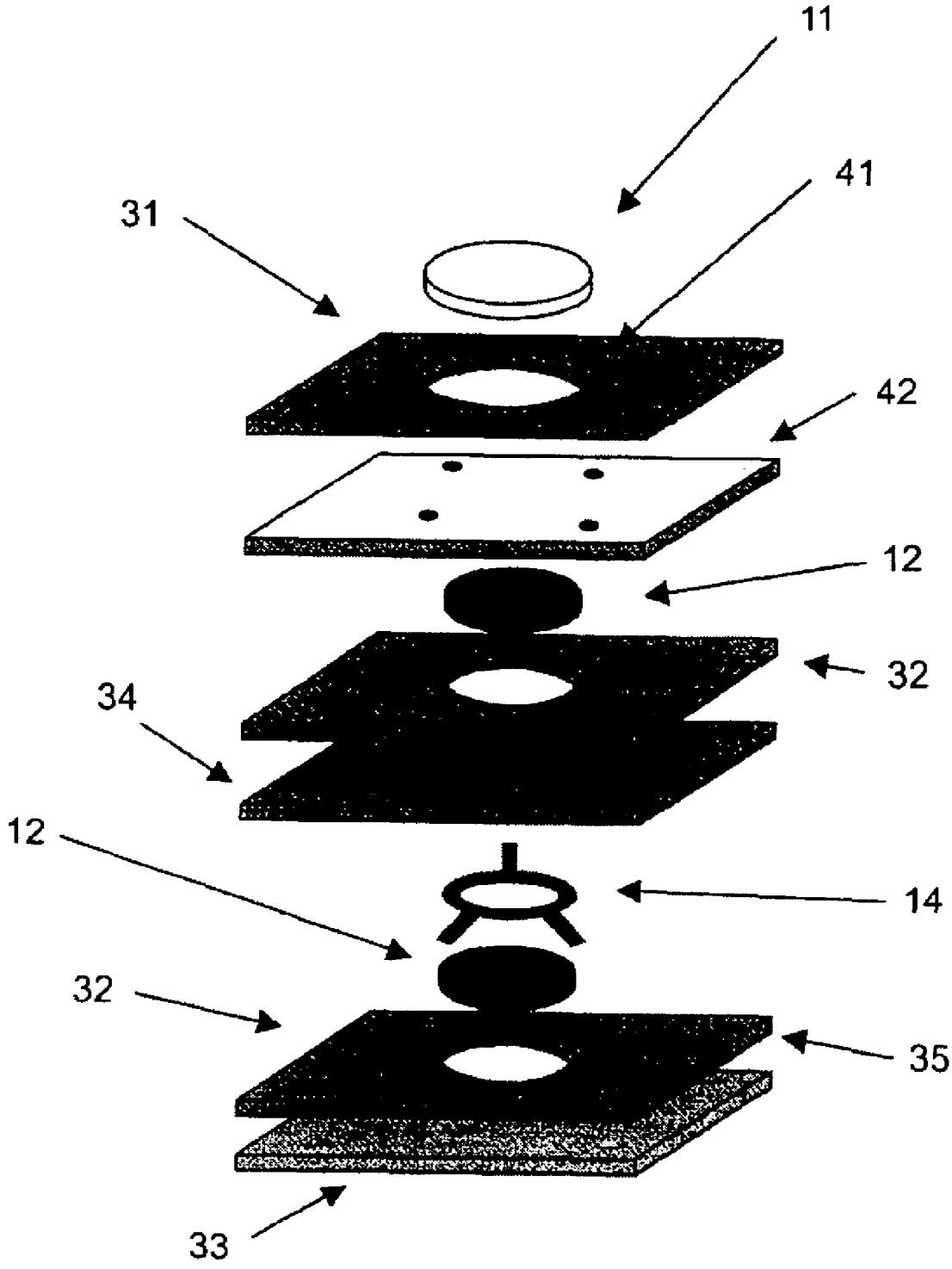
FIG. 4 is a schematic view of an LTCC-M ferrite strip-line integrated circulator.

FIG. 4 shows a stripline circulator structure using LTCC-M. As compared to the micro-strip version of FIG. 3, the strip-line version, as shown in FIG. 4, has better isolation, insertion loss, and reduced radiation. Two ferrite discs 12 are used in this embodiment of the invention. And, the coupling of the magnetic field can be improved by including ferrite filled vias 41 to form a more advantageous magnetic field pattern. An additional insulating layer 42 can be used in conjunction with the second ferrite disk 12 and the ferrite vias 41. Otherwise, the materials, construction, and layers are similar to those used in FIG. 3.

In another embodiment of either the micro-strip circulator, or the strip-line circulator, instead of cofiring magnets 11 in place, wells (not shown) can be formed in the LTCC-M structure to later accommodate magnets 11 following cofiring.

Figure 5:
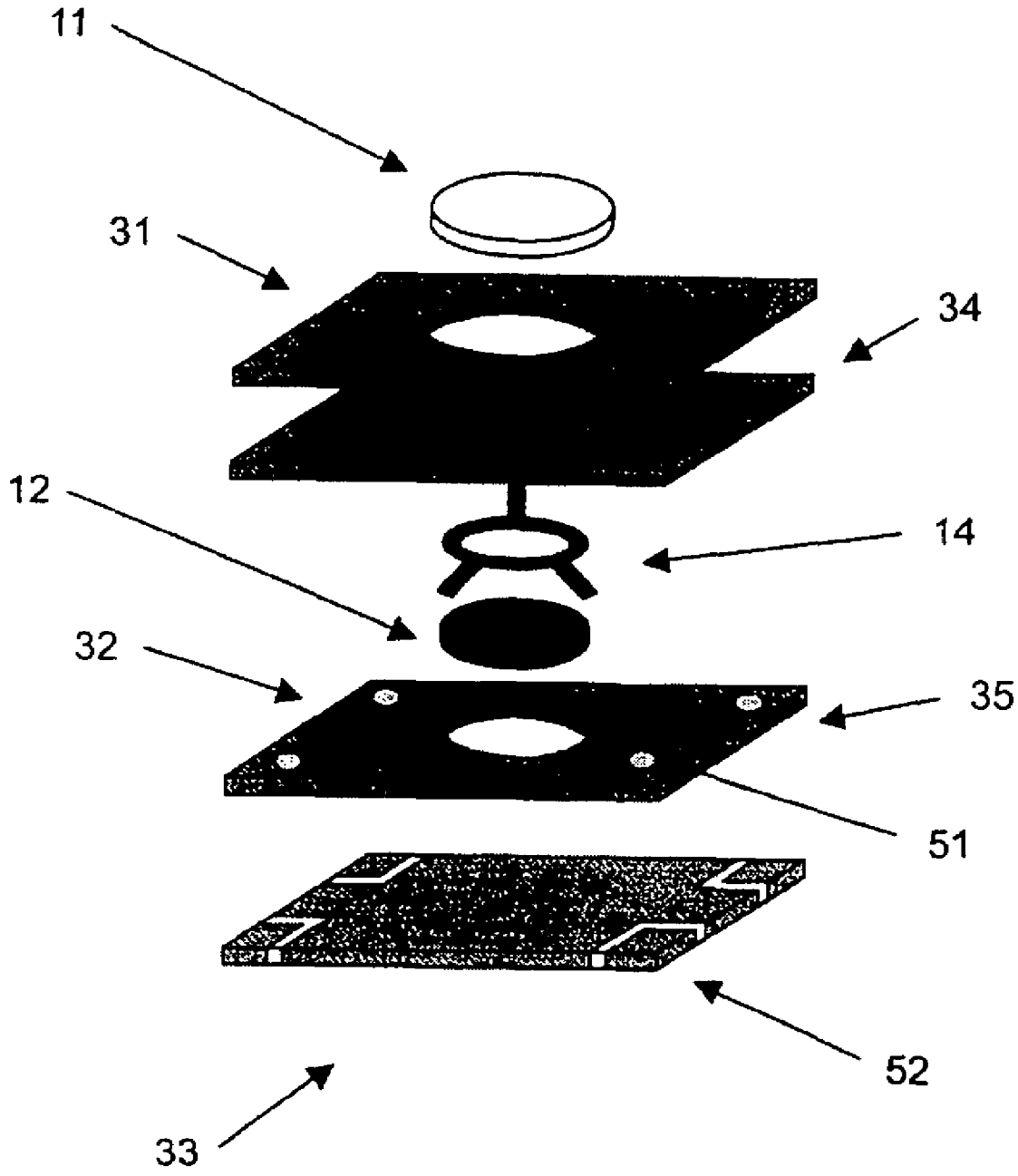
FIG. 5 is a schematic view of an LTCC-M ferrite integrated circulator with conducting terminals formed on the base.

FIG. 5 shows an embodiment as a variation of either the micro-strip circulator of FIG. 3, or the strip-line circulator of FIG. 4. Here, isolated conducting terminals 52, are connected to the ports of conductor junction 14. The electrical connections from the terminals 52 to conductor junction 14 are made by metal vias 51. This construction provides an economical and rugged package suitable for attachment to a printed circuit board using surface mount technology (SMT).

Figure 6:
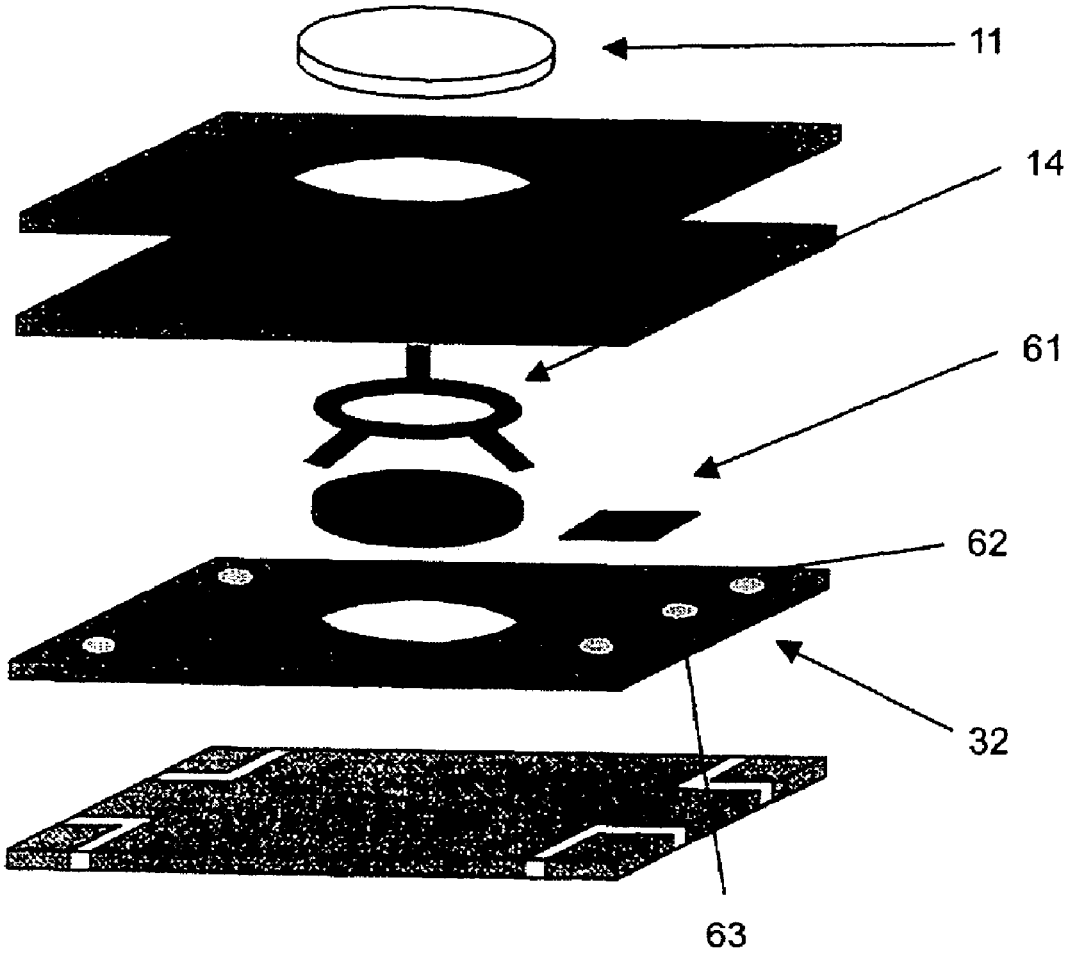
FIG. 6 is a schematic view of an LTCC-M ferrite integrated circulator with a resistive termination; and, FIG. 7 is a schematic diagram showing a circulator application in a radio frequency (RF) transmitter.
Figure 7:
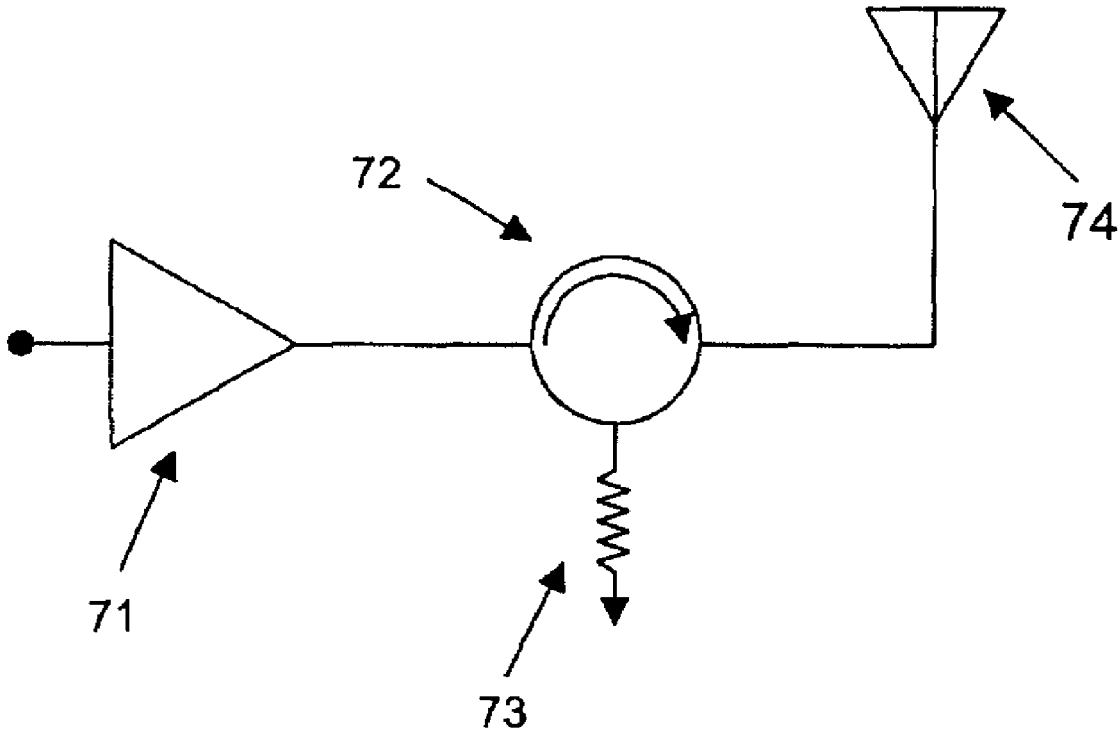

FIG. 6 shows another embodiment that also can be a variation of either the micro-strip circulator of FIG. 3, or the strip-line circulator of FIG. 4. In this embodiment, an isolator is formed by the addition of resistive termination 61. The termination is constructed on the insulating layer 32. One end of the termination is connected to the isolated port of the conductor junction 14. The other end of the termination is connected to ground by conducting vias 63 located in the insulating layer. Heat generated by the energy absorbed in resistive termination 61 is carried away to the Ferrous Base through thermally conductive vias 62. Thermally conductive vias 62 are and electrically insulating. A typical application is shown in FIG. 7. When used with transmitter 71 and antenna 74, circulator 72 (configured as an isolator with resistive termination 73) provides impedance matching and protects the transmitter from reflected signals from the antenna.

II. General Features of LTCC-M

Multilayer ceramic circuit boards are made from layers of green ceramic tapes. A green tape is made from particular glass compositions and optional ceramic powders, which are mixed with organic binders and a solvent, cast and cut to form the tape. Wiring patterns can be screen printed onto the tape layers to carry out various functions. Vias are then punched in the tape and are filled with a conductor ink to connect the wiring on one green tape to wiring on another green tape. The tapes are then aligned, laminated, and fired to remove the organic materials, to sinter the metal patterns and to crystallize the glasses. This is generally carried out at temperatures below about 1000° C., and preferably from about 750-950° C. The composition of the glasses determines the coefficient of thermal expansion, the dielectric constant and the compatibility of the multilayer ceramic circuit boards to various electronic components. Exemplary crystallizing glasses with inorganic fillers that sinter in the temperature range 700 to 1000° C. are Magnesium Alumino-Silicate, Calcium Boro-Silicate, Lead Boro-Silicate, and Calcium Alumino-Boricate.

More recently, metal support substrates (metal boards) have been used to support the green tapes. The metal boards lend strength to the glass layers. Moreover since the green tape layers can be mounted on both sides of a metal board and can be adhered to a metal board with suitable bonding glasses, the metal boards permit increased complexity and density of circuits and devices. In addition, passive and active components, such as resistors, inductors, and capacitors can be incorporated into the circuit boards for additional functionality. Thus this system, known as low temperature cofired ceramic-metal support boards, or LTCC-M, has proven to be a means for high integration of various devices and circuitry in a single package. The system can be tailored to be compatible with devices including silicon-based devices, indium phosphide-based devices and gallium arsenide-based devices, for example, by proper choice of the metal for the support board and of the glasses in the green tapes.

The ceramic layers of the LTCC-M structure must be matched to the thermal coefficient of expansion of the metal support board. Glass ceramic compositions are known that match the thermal expansion properties of various metal or metal matrix composites. The LTCC-M structure and materials are described in U.S. Pat. No. 6,455,930, *"Integrated heat sinking packages using low temperature co-fired ceramic metal circuit board technology"*, issued Sep. 24, 2002 to Ponnuswamy, et al and assigned to Lamina Ceramics. U.S. Pat. No. 6,455,930 is incorporated by reference herein. The LTCC-M structure is further described in U.S. Pat. No. 5,581,876, 5,725,808, 5,953,203, and 6,518,502, all of which are assigned to Lamina Ceramics and also incorporated by reference herein.

The metal support boards used for LTCC-M technology do have a high thermal conductivity, but some metal boards have a high thermal coefficient of expansion, and thus a bare die cannot always be directly mounted to such metal support boards. However, some metal support boards are known that can be used for such purposes, such as metal composites of copper and molybdenum (including from 10-25% by weight of copper) or copper and tungsten (including 10-25% by weight of copper), made using powder metallurgical techniques. Copper clad Kovar®, a metal alloy of iron, nickel, cobalt and manganese, a trademark of Carpenter Technology, is a very useful support board. AlSiC is another material that can be used for direct attachment, as can aluminum or copper graphite composites.

Another instance wherein good cooling is required is for thermal management of flip chip packaging. Densely packed microcircuitry, and devices such as amplifiers, oscillators and the like which generate large amounts of heat, can also use LTCC-M techniques advantageously. Metallization on the top layers of an integrated circuit bring input/output lines to the edge of the chip so as to be able to wire bond to the package or module that contains the chip. Thus the length of the wirebond wire becomes an issue; too long a wire leads to parasitics. The cost of very high integration chips may be determined by the arrangement of the bond pads, rather than by the area of silicon needed to create the circuitry. Flip chip packaging overcomes at least some of these problems by using solder bumps rather than wirebond pads to make connections. These solder bumps are smaller than wire bond pads and, when the chip is turned upside down, or flipped, solder reflow can be used to attach the chip to the package. Since the solder bumps are small, the chip can contain input/output connections within its interior if multilayer packaging is used. Thus the number of transistors in it, rather than the number and size of bond pads will determine the chip size.

However, increased density and integration of functions on a single chip leads to higher temperatures on the chip, which may prevent full utilization of optimal circuit density. The only heat sinks are the small solder bumps that connect the chip to the package. If this is insufficient, small active or passive heat sinks must be added on top of the flip chip. Such additional heat sinks increase assembly costs, increase the number of parts required, and increase the package costs. Particularly if the heat sinks have a small thermal mass, they have limited effectiveness as well.

In the simplest form of the present invention, LTCC-M technology is used to provide an integrated package for a semiconductor component and accompanying circuitry, wherein the conductive metal support board provides a heat sink for the component. A bare semiconductor die, for example, can be mounted directly onto a metal base of the LTCC-M system having high thermal conductivity to cool the semiconductor component. In such case, the electrical signals to operate the component must be connected to the component from the ceramic. Indirect attachment to the metal support board can also be used. In this package, all of the required components are mounted on a metal support board, incorporating embedded passive components such as conductors and resistors into the multilayer ceramic portion, to connect the various components, i.e., semiconductor components, circuits, heat sink and the like, in an integrated package. The package can be hermetically sealed with a lid.

For a more complex structure having improved heat sinking, the integrated package of the invention combines a first and a second LTCC-M substrate. The first substrate can have mounted thereon a semiconductor device, and a multilayer ceramic circuit board with embedded circuitry for operating the component; the second substrate has a heat sink or conductive heat spreader mounted thereon. Thermoelectric (TEC) plates (Peltier devices) and temperature control circuitry are mounted between the first and second substrates to provide improved temperature control of semiconductor devices. A hermetic enclosure can be adhered to the metal support board.

The use of LTCC-M technology can also utilize the advantages of flip chip packaging together with integrated heat sinking. The packages of the invention can be made smaller, cheaper and more efficient than existing present-day packaging. The metal substrate serves as a heat spreader or heat sink. The flip chip can be mounted directly on the metal substrate, which is an integral part of the package, eliminating the need for additional heat sinking. A flexible circuit can be mounted over the bumps on the flip chip. The use of multilayer ceramic layers can also accomplish a fan-out and routing of traces to the periphery of the package, further improving heat sinking. High power integrated circuits and devices that have high thermal management needs can be used with this new LTCC-M technology.

The present invention relates to a low temperature cofired ceramic-metal (LTCC-M) integrated non-reciprocal device for directing radio frequency (RF) signals comprising at least one ferrite disk situated in a magnetic field caused by at least one magnet and a ferrous base plate acting as a magnetic return path; a conductor junction having 3 ports for coupling the radio frequency signals to the circulator; and a plurality of LTCC-M insulating layers for positioning the at least one magnet, the at least one ferrite disk, and to support the conductor junction.

According to an embodiment of the present invention, the non-reciprocal device may include a conductor junction that forms a micro-strip transmission line for coupling the RF signals to the non-reciprocal device.

According to an embodiment of the present invention, the non-reciprocal device may include a conductor junction that forms a stripline transmission line for coupling the RF signals to the non-reciprocal device.

According to an embodiment of the present invention, the non-reciprocal device may include ferrite filled vias to improve the closure of the magnetic field.

According to an embodiment of the present invention, the non-reciprocal device may include isolated terminals on the base plate and metal vias to electrically couple the conductor junction to a printed circuit board (PCB). According to an embodiment of the present invention, the non-reciprocal device may be affixed to and electrically coupled to the PCB by surface mount technology (SMT).

According to an embodiment of the present invention, the non-reciprocal device may comprise a resistive termination such that the composite device acts as an isolator. According to an embodiment of the present invention, the resistive termination is electrically coupled to the conductor junction by metal vias. According to an embodiment of the present invention, the resistive termination is thermally coupled to the base plate by thermal vias to remove heat dissipated by the termination.

According to an embodiment of the present invention, the non-reciprocal device is hermetically sealed by the LTCC-M package.

The present application relates to a method of making an LTCC-M circulator comprising the steps of providing one or more green sheets of insulating ceramic; providing at least one magnet and a ferrous base plate; providing a contact junction; stacking the sheets so that there is at least one insulating ceramic sheet between the magnet and the ferrite disk; and cofiring the stacked assembly to form an integrated LTCC-M circulator device.

According to an embodiment of the present invention, the providing step may comprise providing green sheets comprising glass compositions and optional ceramic powders, which are mixed with organic binders and a solvent, cast and cut to form the tape, the layers having a pair of major surfaces.

According to an embodiment of the present invention, the method may further comprise fabricating a conductor junction by a process selected from the group consisting of screen printing, evaporating, and sputtering.

According to an embodiment of the present invention, the method may further comprise joining the layers by a method selected from the group consisting of epoxying, brazing, and soldering.

According to an embodiment of the present invention, the method may further comprise punching holes in the green sheets to hold electrically conductive vias for connecting the conductor junction.

According to an embodiment of the present invention, the method may further comprise punching holes in the green sheets to hold thermally conductive vias for dissipating heat from the internal layers.

According to an embodiment of the present invention, the method may further comprise providing a resistive termination to form an isolator.

According to an embodiment of the present invention, the method may further comprise providing at least one well to house the at least one magnet after cofiring.

It is understood that the embodiments describe herein are illustrative of only a few of the many possible specific embodiments, which can represent applications of the invention. Numerous and varied other arrangements can be made by those skilled in the art without departing from the spirit and scope of the invention.

We claim:

1. A low temperature cofired ceramic-metal (LTCC-M) integrated non-reciprocal device for directing radio frequency (RF) signals, comprising:

a ferrous base plate;

a plurality of LTCC-M insulating layers situated above the ferrous base plate;

a ferrite disk at least partially within the plane of a first LTCC-M insulating layer of the plurality of LTCC-M insulating layers;

a conductor junction having 3 ports for coupling the RF signals to the non-reciprocal device, the conductor junction situated above the ferrite disk;

a permanent magnet at least partially within the plane of a second LTCC-M insulating layer of the plurality of LTCC-M insulating layers, the second LTCC-M insulating layer located above the conductor junction, wherein the ferrous base plate acts as a magnetic return path; and a third LTCC-M insulating layer of the plurality of LTCC-M insulating layers at least partially situated between the ferrite disk and the permanent magnet.

2. The non-reciprocal device of claim 1, wherein at least one of the first and third insulating layers comprise a ground plane on at least one of a top and bottom surface.

3. The non-reciprocal device of claim 1, further comprising a resistive termination configured such that the device acts as an isolator.

4. The non-reciprocal device of claim 1, wherein the non-reciprocal device is hermetically sealed by a LTCC-M package.

5. The nonreciprocal device of claim 1, wherein at least one of the LTCC-M insulating layers includes at least one ferrite filled via.

6. A low temperature cofired ceramic-metal (LTCC-M) integrated non-reciprocal device for directing RF signals, comprising:

a ferrous base layer;

a first LTCC-M insulating layer above the ferrous base layer;

a first ferrite disk at least partially within the plane of the first LTCC-M insulating layer;

a conductor junction above the first ferrite disk;

a second LTCC-M insulating layer above the conductor junction;

a third LTCC-M insulating layer above the second LTCC-M insulating layer;

a second ferrite disk at least partially within the plane of the third LTCC-M insulating layer;

a fourth LTCC-M insulating layer above the second ferrite disk; and a permanent magnet at least partially within the plane of the fourth LTCC-M insulating layer.

7. The device of claim 6, further comprising an intervening insulating layer provided between the third and fourth insulating layers, wherein the intervening insulating layer includes at least one ferrite filled via.

8. The non-reciprocal device of claim 6, further comprising a resistive termination configured such that the device acts as an isolator.

9. The non-reciprocal device of claim 6, wherein the non-reciprocal device is hermetically sealed by an LTCC-M package.

10. The nonreciprocal device of claim 6, wherein at least one of the LTCC-M insulating layers includes at least one ferrite filled via.

* * * * *

UNITED STATES PATENT AND TRADEMARK OFFICE

CERTIFICATE OF CORRECTION

PATENT NO. : 7,336,140 B2
APPLICATION NO. : 11/364272
DATED : February 26, 2008
INVENTOR(S) : Joseph B. Mazzochette et al.

It is certified that error appears in the above-identified patent and that said Letters Patent is hereby corrected as shown below:

On the Title Page, Item (75)

Please delete "Egg Habor City, NJ" and insert -- Egg Harbor City, NJ --

Signed and Sealed this

Twenty-seventh Day of May, 2008

JON W. DUDAS
*Director of the United States Patent and Trademark Office*